US007857099B2

(12) United States Patent
Choate

(10) Patent No.: US 7,857,099 B2
(45) Date of Patent: Dec. 28, 2010

(54) TWIN RETRACTABLE FOR FALL ARREST

(75) Inventor: Gary E. Choate, Lakewood, CO (US)

(73) Assignee: Reliance Industries, LLC, Deer Park, TX (US)

( * ) Notice: Subject to any disclaimer, the term of this patent is extended or adjusted under 35 U.S.C. 154(b) by 20 days.

(21) Appl. No.: 10/131,582

(22) Filed: Apr. 23, 2002

(65) Prior Publication Data

US 2005/0145435 A1 Jul. 7, 2005

Related U.S. Application Data

(60) Provisional application No. 60/286,253, filed on Apr. 24, 2001.

(51) Int. Cl.
*A62B 1/00* (2006.01)

(52) U.S. Cl. ..... 182/234; 182/239

(58) Field of Classification Search ..... 182/3–7, 182/36; 242/378.4

See application file for complete search history.

(56) References Cited

U.S. PATENT DOCUMENTS 2,317,346 A * 4/1943 Reith ..... 182/4
3,100,669 A * 8/1963 Monroe ..... 297/478
3,317,936 A * 5/1967 Johnson et al. ..... 441/84
4,130,176 A * 12/1978 Paulie ..... 182/4
4,164,336 A * 8/1979 Higbee et al. ..... 242/378.4
4,344,589 A * 8/1982 Rumpf ..... 242/378.4
4,470,556 A * 9/1984 Matsuoka ..... 242/378.4
4,765,558 A * 8/1988 Higbee ..... 242/382.2
4,877,110 A * 10/1989 Wolner ..... 182/232
4,991,689 A * 2/1991 Cole ..... 182/3
5,287,943 A * 2/1994 Bell ..... 182/3
5,522,472 A * 6/1996 Shuman et al. ..... 182/3

(Continued)

FOREIGN PATENT DOCUMENTS

JP 04212381 A * 8/1992

OTHER PUBLICATIONS

2007/0151805, Mar. 17, 2010, Office Action in U.S. Appl. No. 11/619,014.

*Primary Examiner*—Alvin C Chin-Shue
(74) *Attorney, Agent, or Firm*—Ramon L. Pizarro; Edwin H. Crabtree

(57) ABSTRACT

A retractable lanyard mechanism that includes a housing, a frame and a drum that is rotatably supported from the frame mounted within the housing. The drum includes a pair of spaced apart disks, the spaced apart disks being attached to opposite ends of a spool, each spaced apart disk having a perimeter including at least one sperrad. A locking bar that is pivotally mounted from the frame, the locking bar extending from the frame at a location next the perimeter of each of the spaced apart disks and is movable from an up position wherein the locking bar does not engage the sperrad on each of the spaced apart disks, and a down position wherein the locking bar engages the sperrad on each of the disks, the locking bar mechanism being movable from the up position to the down position by a momentum pawl mechanism that is mounted from the frame, so that rotation of both of the spaced apart disks is stopped by moving the locking bar to the down position in response to a level of momentum achieved by the momentum pawl mechanism.

4 Claims, 9 Drawing Sheets

U.S. PATENT DOCUMENTS 6,283,398 B1 * 9/2001 Specht ..... 242/383.4
6,868,941 B1 * 3/2005 Hermann ..... 182/3
2007/0151805 A1 7/2007 Betcher et al.

* cited by examiner

Worker attached to anchor point using a retractable lanyard

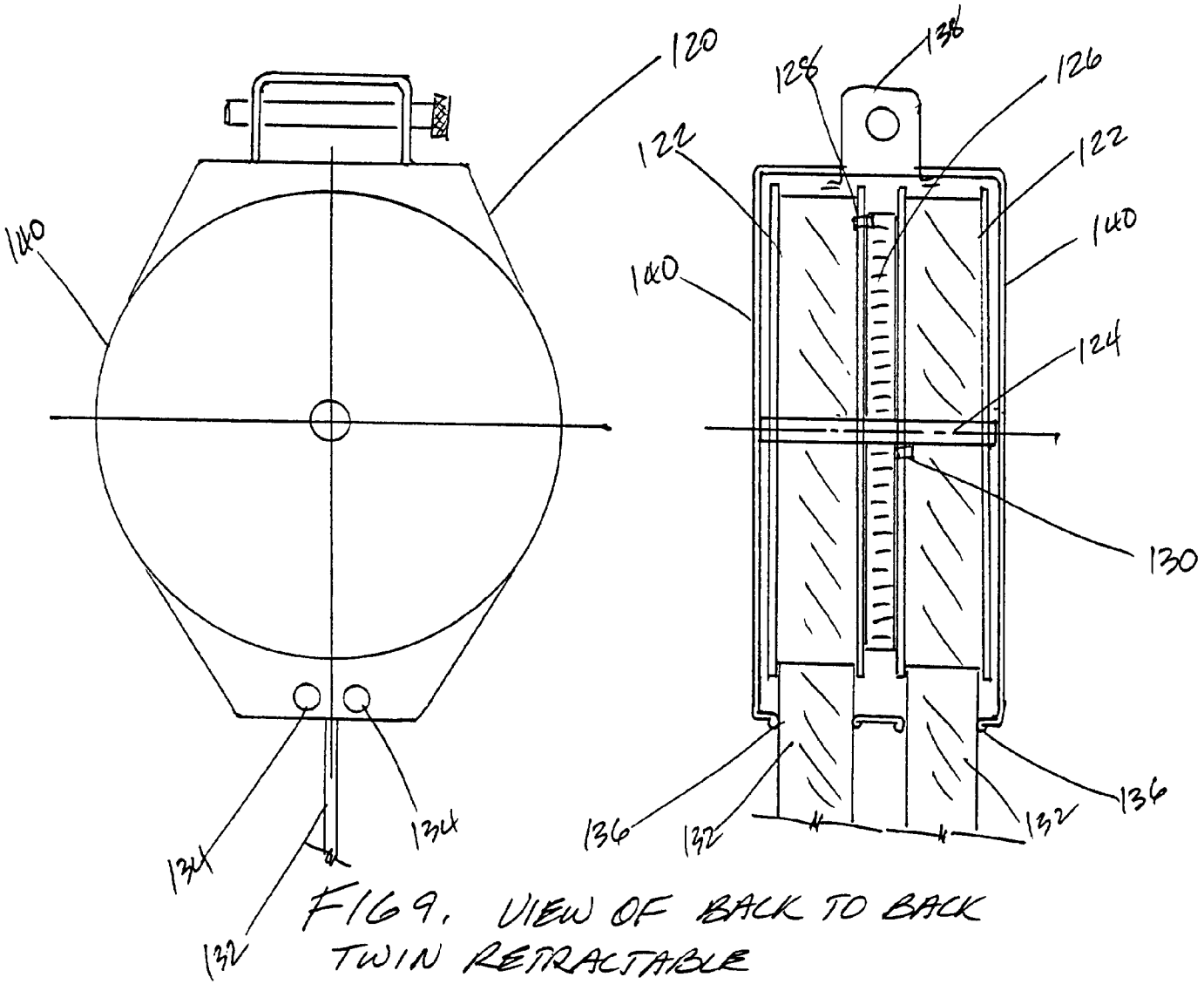
FIG 9. VIEW OF BACK TO BACK TWIN RETRACTABLE

TWIN RETRACTABLE FOR FALL ARREST

REFERENCE TO RELATED APPLICATIONS

This application claims the benefit of my provisional application having Ser. No. 60/286,253, filed Apr. 24, 2001.

BACKGROUND OF THE INVENTION

1. Field of the Invention

The present invention relates to a new and improved method for arranging a mechanically activated refraction system for a twin lanyard used in fall arrest. Additionally, this invention relates to a method for creating a retractable lifeline with twin retractable reels for the take-up of webbing or cable. Additionally this invention relates to a method for creating a lightweight retractable reel located in the center of a lanyard that can be used to take-up webbing from both ends of the webbing at the same time. Additionally, this invention relates to a method for activating an internal locking bar on a retractable take-up reel by the use of an over-center spring that can be re-positioned under light load to create a normally open or normally locked condition of operation.

2. Known Art

Fall arrest lanyards are used in most industrial and commercial applications requiring fall arrest for individual workers to attach those workers to fall arrest anchors. These lanyards may be in the form of fixed length steel or webbing shock-absorbing lanyards or variable length shock-absorbing retractable lanyards. The fixed length lanyards are usually lighter in weight but limit mobility due to their fixed length. They also introduce the possibility of free-falls equal to twice their length if the fall arrest anchor is at or below the foot level of the worker. The great advantage of the retractable lanyard is that (if the retractable is located overhead) the free-fall distance is just the lock-up distance of the retractable (usually less than 12-in.). The disadvantage of the retractable lanyard is that it is usually heavier than a fixed length webbing lanyard.

A problem with using shock-absorbing lanyards for fall-arrest is encountered when a worker must move from one work site to another that is farther away than the length of his retractable or fixed length lanyard. When this occurs, the worker is usually forced to disconnect from his anchorage and move or free-climb without fall-arrest protection until he reaches his next workstation and can reconnect. To solve this problem, manufacturers have created what is called a "twin lanyard". This consists of a shock-absorbing element to which 2 fixed length lanyards are connected. When using a twin lanyard, a worker can be mobile and move from one workstation to another without ever being disconnected from an anchor point. Movement with this type of twin lanyard is accomplished as follows:

1. Connect Lanyard A to Anchor I,
2. Move to Anchor 2 and connect Lanyard B
3. Return to Anchor I and disconnect Lanyard A
4. Move to Anchor 3 and connect Lanyard A
5. Return to Anchor 2 and disconnect Lanyard B
6. Move to Anchor 4 and connect Lanyard B (and so on)

The worker has now moved from workstation I to workstation 4 without ever being disconnected.

Another problem encountered when using fixed length twin lanyards is entanglement with the webbing when the lanyard is not attached to an overhead anchorage. Typically the free-end of the lanyard leg that is not attached overhead is connected back to the harness. This leaves a loop in the lanyard at about knee-height. When a worker bends over or stoops down this lanyard leg can slip behind the workers heel and cause him to tumble forward off balance as he begins to stand erect. For this reason some manufacturers have developed small retractable lanyards that attach to the worker's harness and act similar to a fixed length shock-absorbing lanyard except that they keep the lanyard length within the retractable so that it does not become entangled with the worker. The following preferred embodiment of the present invention relates to a method for creating a twin retractable lanyard, and also a method for creating twin retractables that can be positioned in the center of a fixed length retractable lanyard webbing to cause that webbing to shorten in length so that it will decrease fall distance and avoid entanglement.

A preferred embodiment of the present invention also relates to a method for reducing the forces encountered in the locking pawl mechanism of retractable lanyards. In all current designs a locking pawl is energized either centripetally or centrifugally to engage (or lock into) a locking sperrad on the webbing drum to stop the drum rotation and arrest the fall. The abrupt forces that are encountered with this type of engagement can often lead to damage to the pawls and locking mechanism. This present invention provides a new method to separate the locking pawls from the engagement mechanism and uses them only to activate a mechanism that moves the positioning location of an over-center spring so that a locking bar can be pivoted into place to stop the rotation of the drum, thus relieving the forces on the locking pawls. This re-positioning of the over-center spring also means that rebound cannot unlock the drum causing ratcheting of the load because the over-center spring holds the locking bar in its locked position until being reset. Examples of mechanisms that can be used to activate the locking bar can be found throughout the automotive seat-belt retraction mechanism art, and an examples of this art can be found in U.S. Pat. No. 6,254,191 to Yamamoto, et al.; U.S. Pat. No. 5,622,327 to Heath , et al.; U.S. Pat. No. 6,283,398 to Specht, which are incorporated herein in their entirety by reference, together with the references cited therein.

SUMMARY

The present invention relates to an improved method for creating twin retractable fall arrestors and a method for improving the locking method of single or twin retractable. This invention provides a method to create a retractable with twin drums and independent springs to retract webbing independently. It also includes a method to create a retractable with twin drums that use a common retraction spring to retract webbing non-independently. It includes a retraction mechanism that can be mounted in the center of lanyard webbing that can retract the webbing of each lanyard leg independently from its center toward both ends. This invention also relates to a method for using pivotable over-center springs to activate a locking bar to stop the rotation of the retractable drum in either or both of the above methods.

One of the examples shown includes the use of:

a) a frame for holding twin drums to create a twin retractable;
b) a drum with side plates configured to be used as a locking sperrad;
c) a spring to rotate the drum;
d) a locking bar to engage the drum sperrad;
e) springs to activate the locking bar that can be moved so that they can lock in an over center position and will not allow the locking bar to unlock until being repositioned;
1) a mounting mechanism for the frame that will allow it to be attached to a harness;

g) a guide system for the webbing to keep the twin webbing separate as it leaves the frame;

h) a cover for the frame to protect the inner mechanism and soften its outer edges.

Another of the examples shown includes the use of:

a) a frame to hold a single webbing drum that can be attached to the center of a web and cause it to retract equally from each end;

b) a drum with a sperrad shaped outer edge to engage a locking bar c) travelers that guide on the single webbing strand so that the frame cannot rotate with the drum d) a retraction spring e) a locking bar 1) an over center spring mechanism to activate the locking bar g) a guide mechanism for the webbing h) a housing to protect the inner mechanism and soften the outer edges of the frame The present invention also teaches how to make a twin retractable lanyard, each retraction mechanism using the same unique locking mechanism. In the first method a single frame is used that houses two independent drums that rotate side by side on independent bearings and springs. A variation of this is to use a single frame containing two independent drums that rotate one over the other on the same shaft and share a common retraction spring. The second method is to attach independent retractable drums to the center of independent webbing lanyard legs so that the webbing can be retracted or shortened independently of each other. This method can be used on fixed length shock-absorbing lanyards to create retractable legs. Both methods accomplish the purpose of providing the user with a twin shock-absorbing lanyard with retractable legs that can provide the user with 100% tie-off while moving through structures, short fall distances to reduce anchorage loads, and short lanyard lengths to prevent entanglement. The present invention also relates to a method for creating a twin retractable lanyard. In this third method a pair of retraction drums are mounted back to back separated only by a retraction spring that attaches to the OD of one drum and the ID of the adjacent drum. In this way each drum could payout 50% of its line or whatever portion was not already extracted from the adjacent drum.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which:

FIG. 9 is a view of a back-to-back twin retractable.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
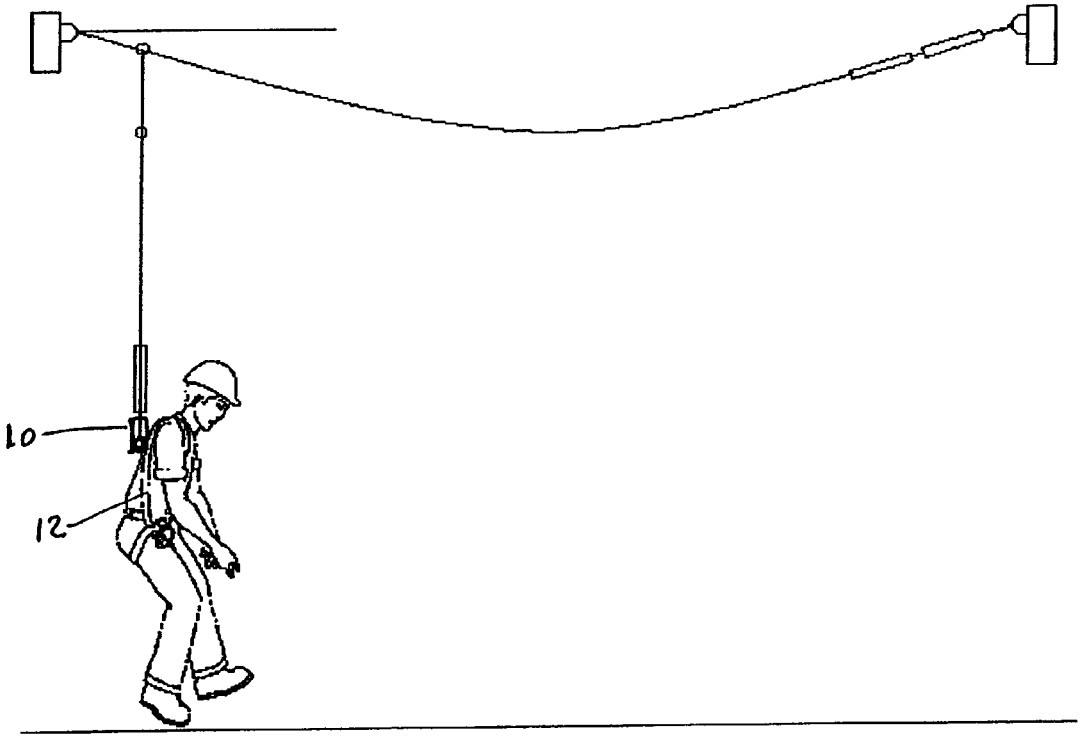
FIG. 1 Shows a worker attached to an anchor point using a retractable lanyard.
Figure 2:
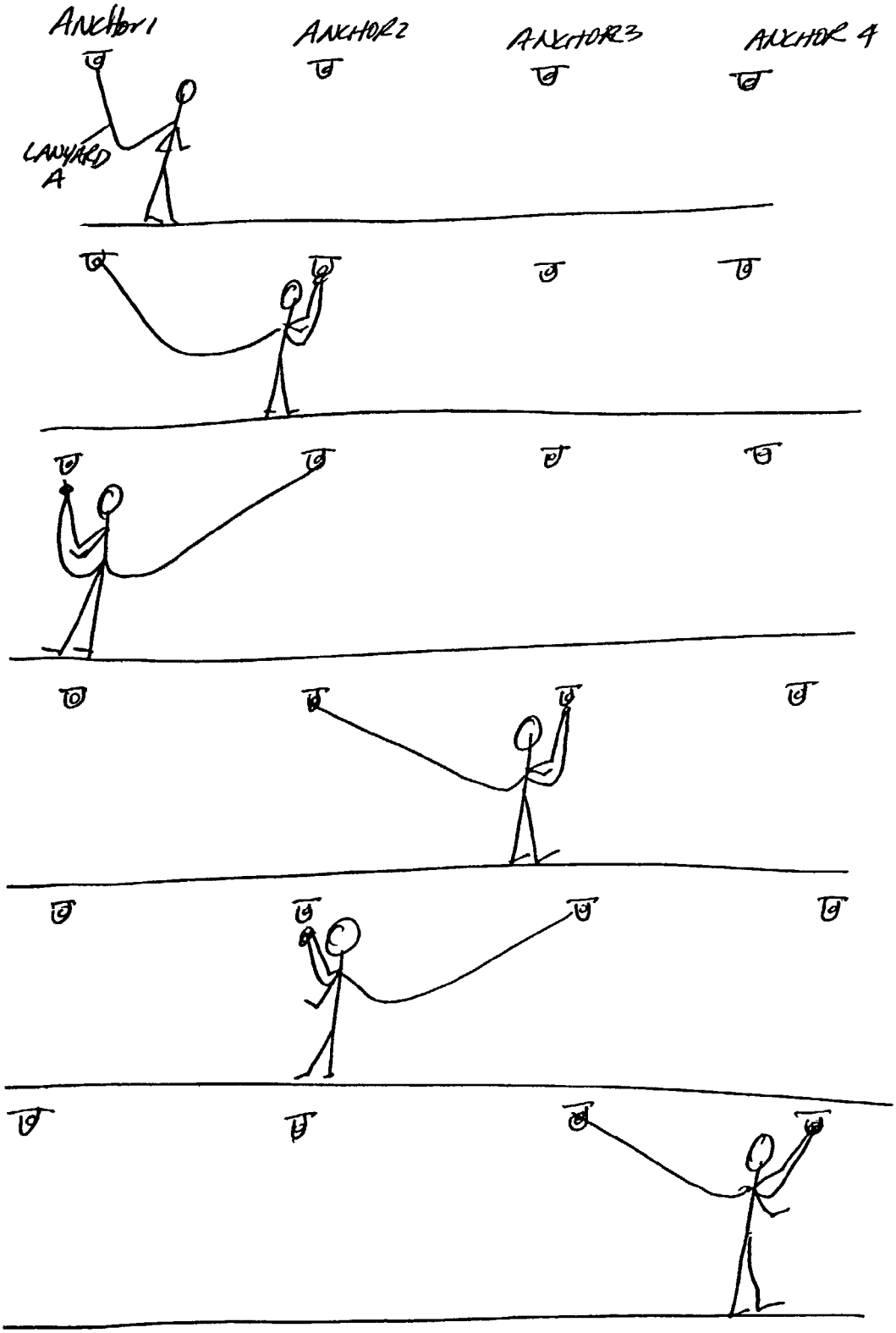
FIG. 2 Shows the twin lanyard attachment method for 100% fall protection.

FIG. 1 is a drawing of a worker with a back mount retractable (10) attached to the dorsal d-ring of his harness (12). This figure shows the preferred method of attachment of the retractable regardless of which type is presented. FIG. 2 shows the method used to create 100% fall protection and still allow a worker mobility to move from one point to another, the twin retractable is mounted to the dorsal d-ring of the harness (12) by means of a screw lock link (16) or carabiner. The retractable contains a drum (18) with a serrated edge (sperrad) (20) that is used to stop the drum rotation when engaged by the locking bar (22). The locking bar (22) is activated by a momentum pawl mechanism (24) when the falling weight that is attached to the webbing (26) accelerates during a fall. The retractable lanyard (14) also contains a retraction spring (28) that is used to retract the webbing (26). So that it does not develop slack that can create free-fall. The webbing (26) is guided out of the nozzle (30) between two steel pins (32). The retractable (14) rests inside a steel frame (34) and is covered externally by a plastic housing (36).

The over-center spring mechanism (38) (which may work in a variety of ways) holds the locking bar (22) in either the up (40) or down (42) position. When the centrifugal (momentum) locking mechanism (24) engages and rotates clockwise (44) it rotates the engagement lever (46) which causes the locking bar (22) to move to the lower (42) position. When the webbing is allowed to retract into the retractable (14) after a fall has occurred, the tips of the sperrad (20) will cause the locking bar (22) to be pushed to its upper position (40) and be held in place. This action allows the unit to reset and resume normal operation. The locking bar (22) crosses the top of both drum side-plates (sperrads) (18) so that the arrest forces are equally distributed to both sides.

Figure 3:
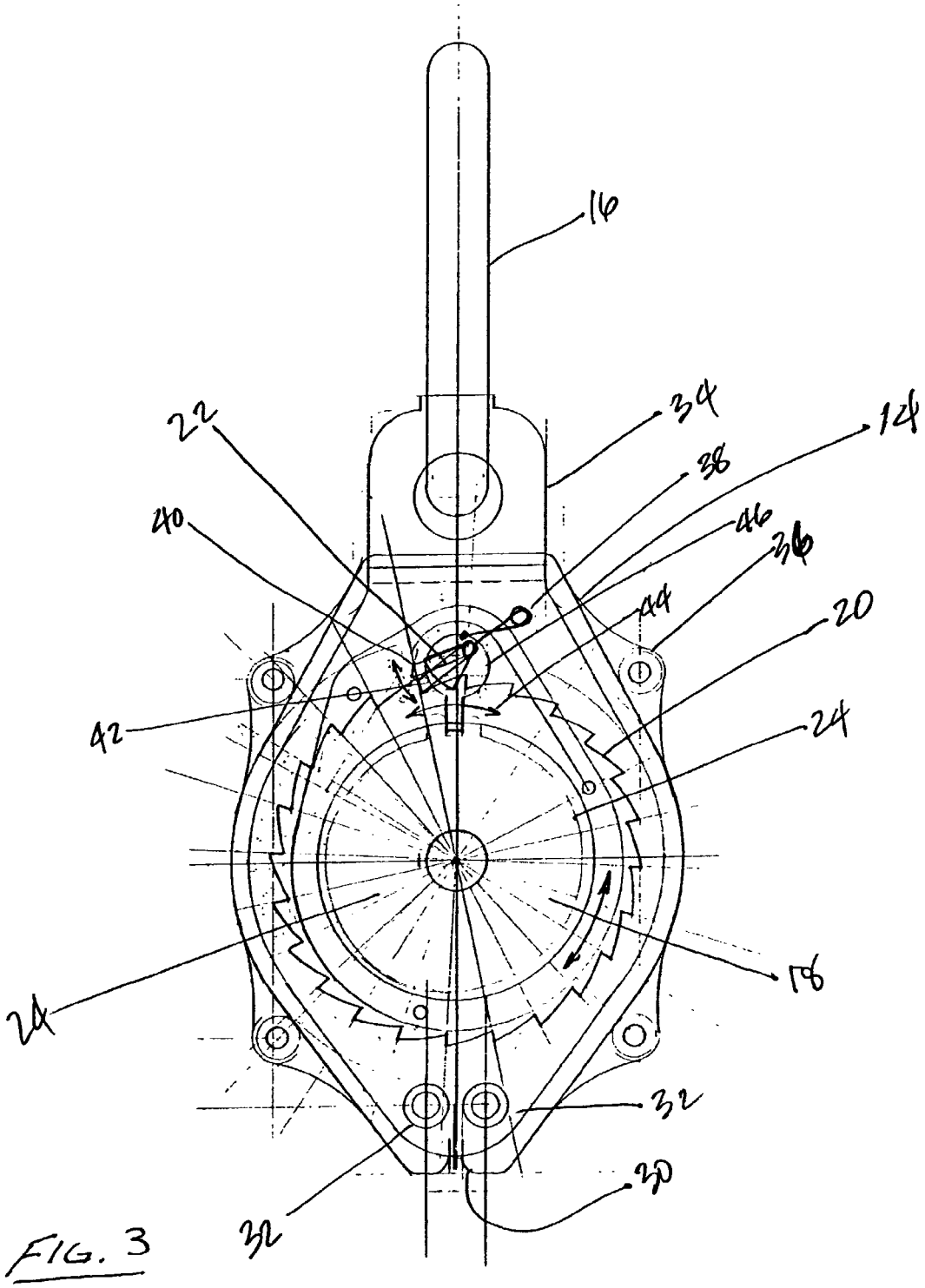
FIG. 3 is a front view of a single retractable lanyard.
Figure 4:
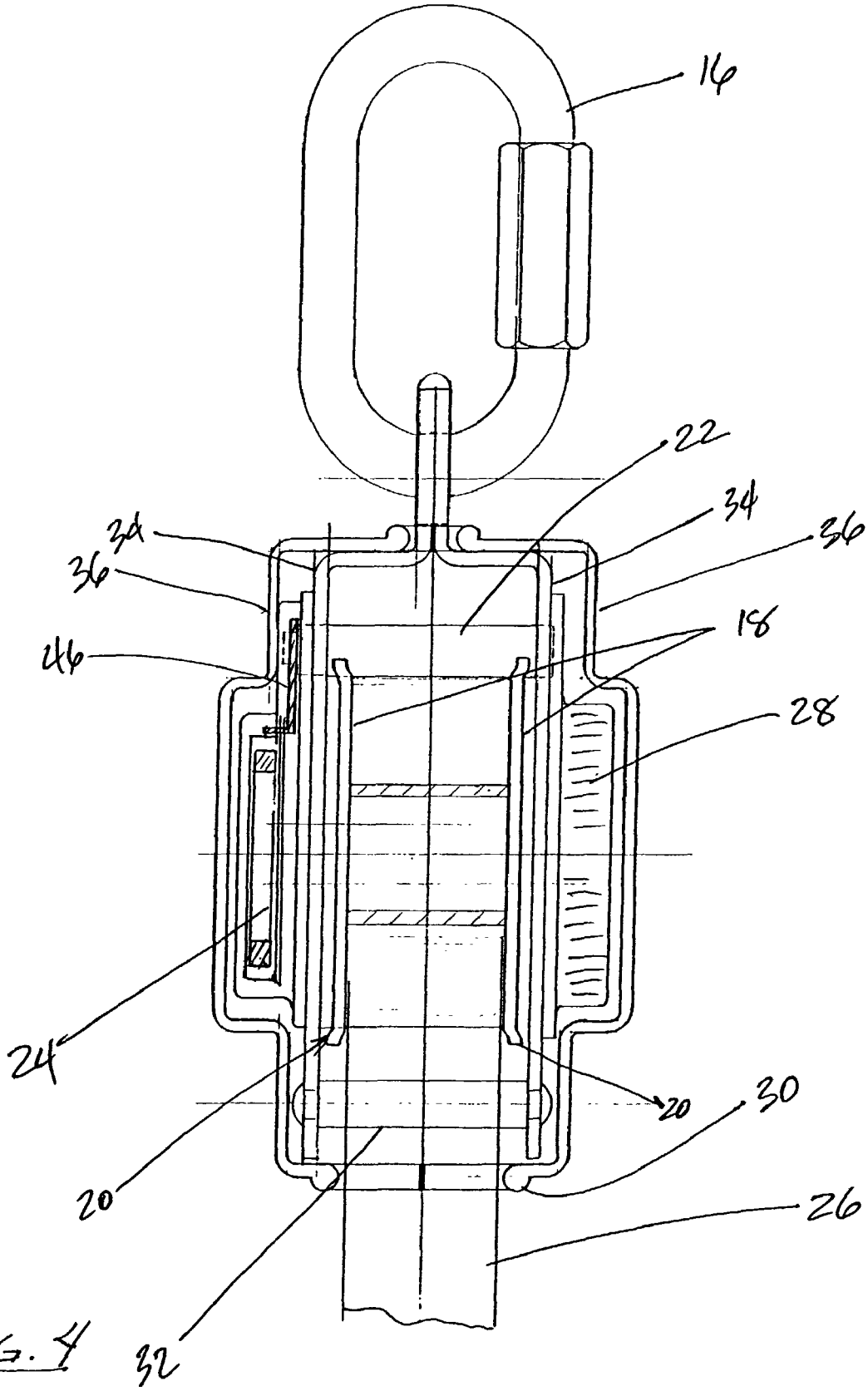
FIG. 4 is a side view of a single retractable lanyard.
Figure 5:
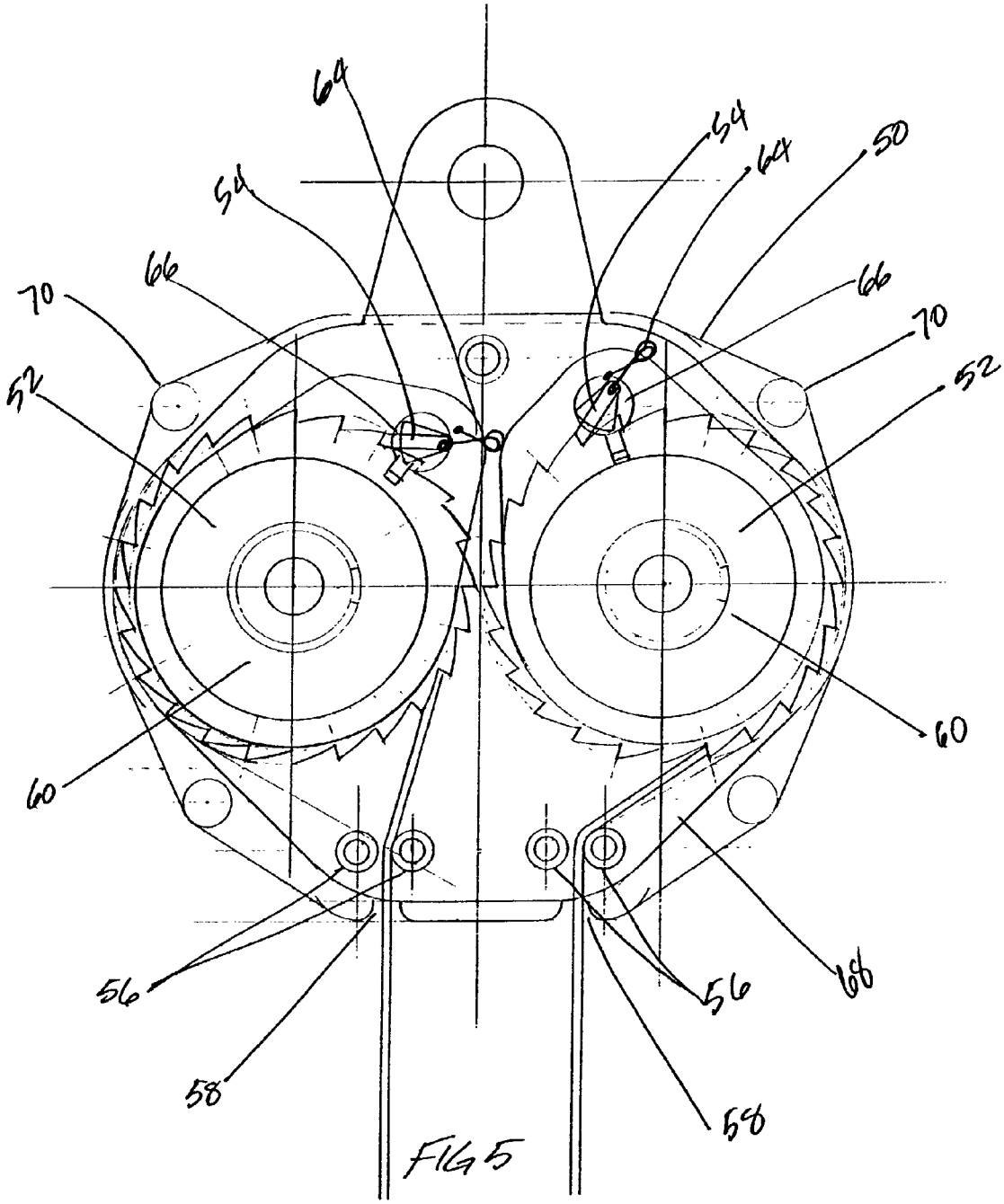
FIG. 5 is a front view of a twin retractable lanyard.
Figure 6:
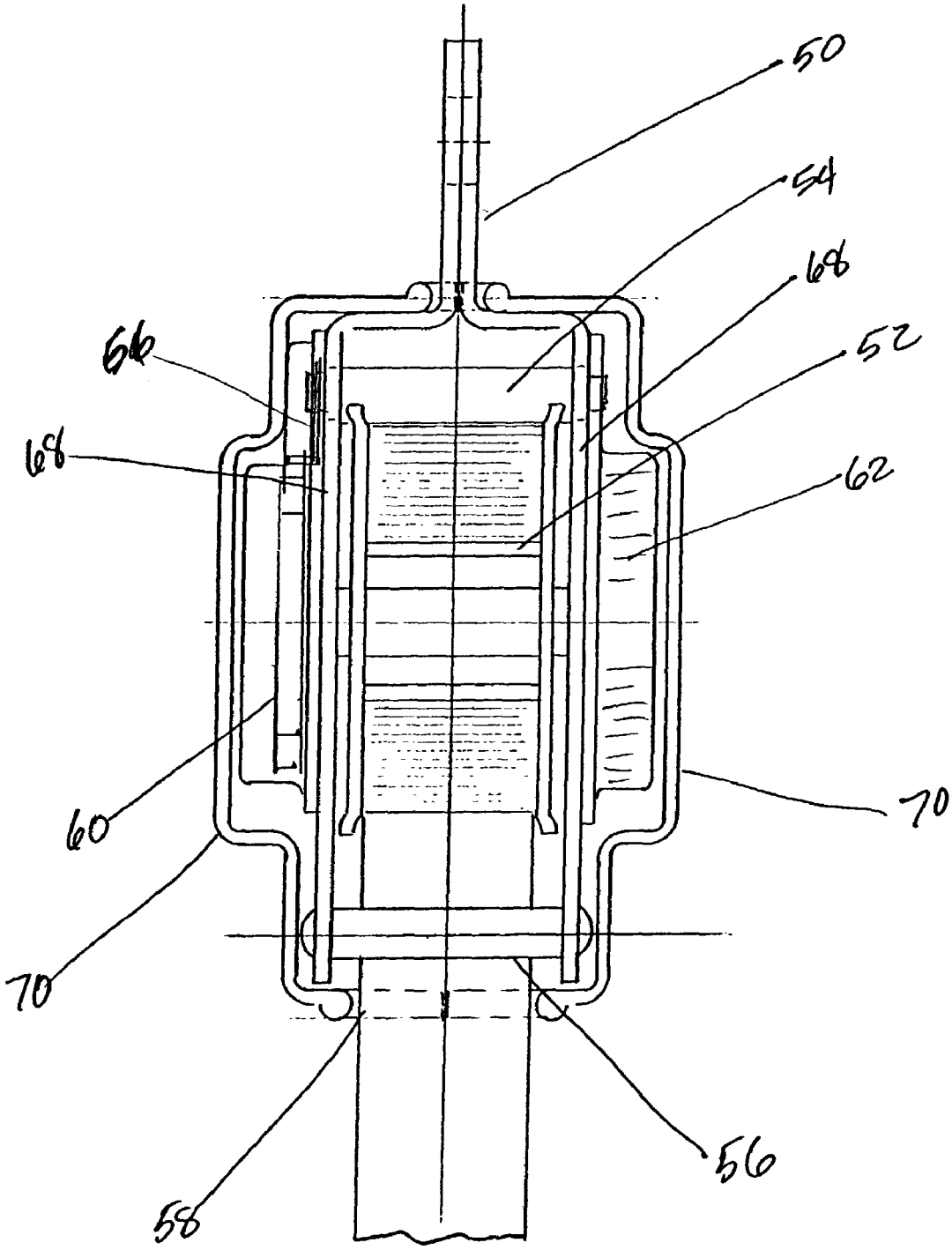
FIG. 6 is a side view of a twin retractable lanyard.

FIG. 5 is the front view and FIG. 6 is the side view of the twin retractable (50). The working mechanism is the same as disclosed in FIG. 3 and FIG. 4. This unit uses two identical drums (52). It has two locking bars (54) and two sets of steel guides (56). It has twin nozzles (58). This unit uses two independent momentum pawl locking mechanisms (60) and two retraction springs (62). It uses twin over-center springs (64) to activate the locking bars (54). The engagement levers (66) are used to connect the locking bars (54) to the momentum pawl mechanism (6). This unit is supported in a steel frame and is covered with a plastic housing (70) similar to those shown in FIGS. 3 and 4. This twin retractable is supported on the back d-ring of the harness in the same manner as those shown in FIGS. 3 and 4.

Figure 7:
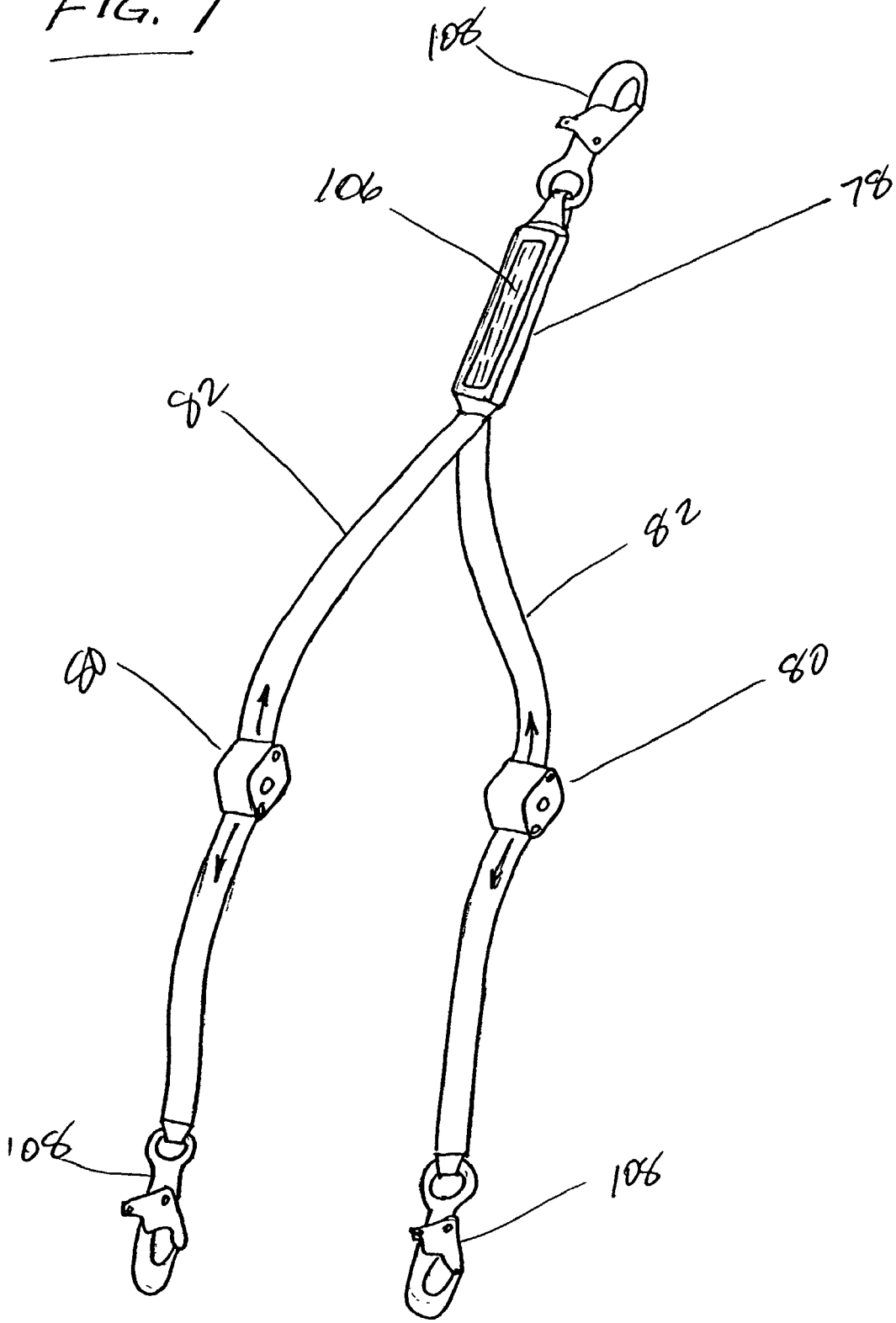
FIG. 7 is a view of an inline twin retractable lanyard.
Figure 8:
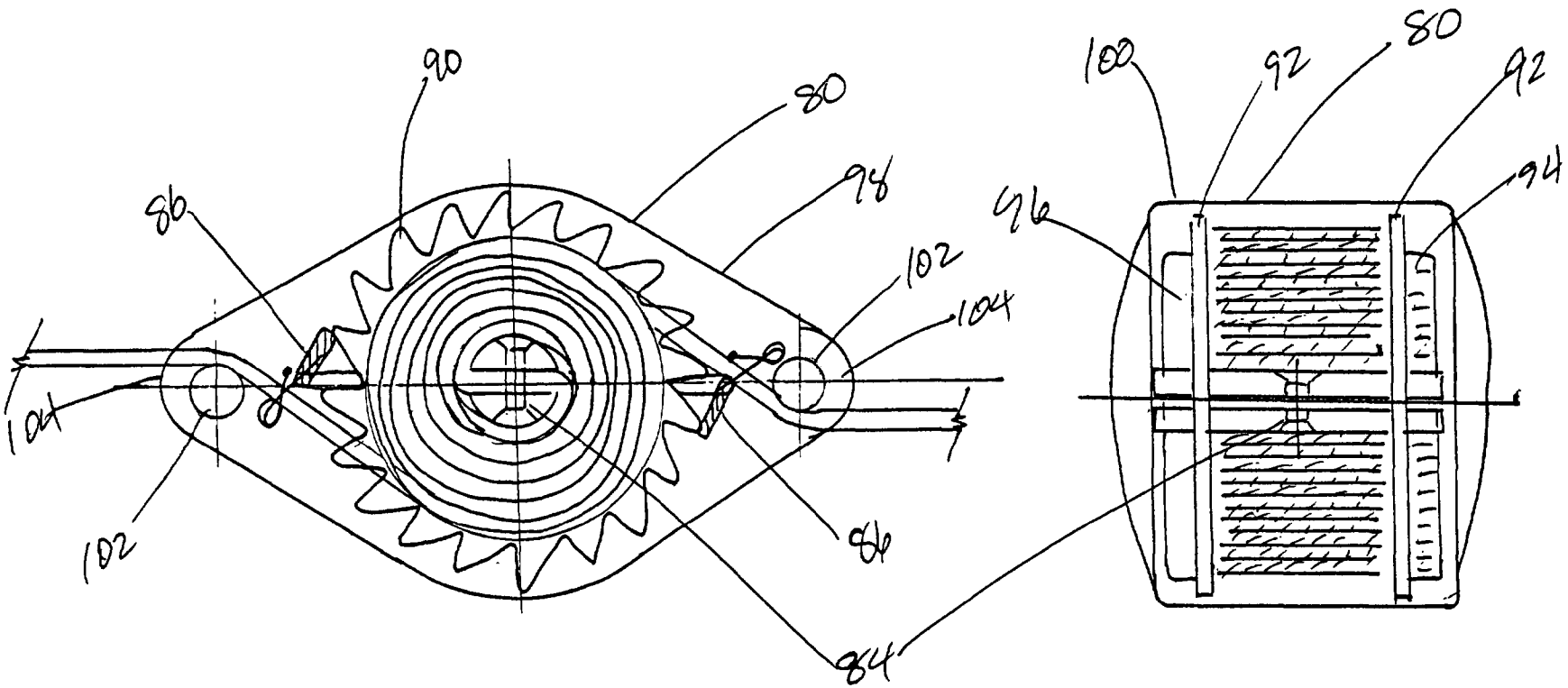
FIG. 8 is a view of an inline retractable mechanism.

FIG. 7 shows a twin shock absorbing retractable lanyard assembly (78). This twin retractable is similar to a fixed length shock-absorbing lanyard except that it has two independent retractor units (80) attached to the center of the lanyard webbing (82). The retractor units (84) shown in FIG. 8 attaches to the center of the web using a through pin (84).

This keeps the retractor (80) centered along the length of the webbing (82). The internal mechanism of the retractor (80) is similar in shape and function to that described in FIGS. 3, 4, 5, and 6. It consists of two locking bars (86) with over-center springs (88). The locking bars engage a sperrad mechanism (90) that is formed by the tips of the retraction drum (92). The retraction of the webbing (82) is accomplished with a retractor spring (94). The pawls are engaged using a momentum pawl mechanism (96) similar to that described in FIGS. 3 and 4. This unit rests in a steel frame (98)and is covered by a plastic housing (100). The webbing is guided using two steel pins (102) at the nozzle exits (104). Shock-absorption for this twin retractable is provided by a tear-away shock pack (106). It is attached to the dorsal d-ring of a harness and to the anchorage with forged locking snap hooks (108) or other connection devices.

FIG. 9 shows a front and side view of a back to back twin retractable (120). In this configuration the drums (122) run parallel to each other on the same center shaft (124). The retraction spring (126) is centered between the two drums (122). The outside of the retraction spring (126) is attached to one drum at (128) and the inside of the retraction spring (126) is attached to the opposite drum at (130). The locking bar mechanism is the same as described previously in FIGS. 3 and 4. Both drums contain webbing (132) that is retracted across guide pins (134) and through a nozzle (136). The entire unit is supported on a steel frame (138) similar to FIGS. 3 and 4, and is covered by a plastic housing (140). The top end is supported by a carabiner or screw-lock link similar to FIGS. 3 and 4. This unit may also be arranged to run on independent retraction springs similar to that shown in FIGS. 5 and 6.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A retractable lanyard mechanism for use by a worker, the worker having a back and legs, comprising:

a pair of retractable lanyards contained in a single housing, the housing has at least one pay out nozzle that cooperates with at least one guide that divides the pay out nozzle and separating the lanyards, the nozzle allowing the retractable lanyards to be drawn or retracted from the housing, each retractable lanyard comprising:

a drum that is rotatably supported from within said single housing, the drum holding the lanyard in a spooled manner on the drum, the drum being connected to a locking mechanism that locks the drum in response to a level of momentum achieved by the rotation of the drum, the locking mechanism comprising teeth on the drum and a pawl that pivots in response to sudden acceleration of the drum to engage at least one of the teeth on the drum to stop rotation of the drum, the rotation axis of the drum of each retractable lanyard being non-coaxial and generally parallel with the rotation axis of the drum of the other retractable lanyard and connected to a retraction spring, so that the lanyards are paid out in a parallel fashion to one another from a same side of each drum and are retracted by the retraction spring to take up slack in each lanyard; and a harness, the harness having a dorsal portion that is adapted for extending over worker's back and includes a set of leg straps, the single housing being pivotally supported from the dorsal portion of the harness allowing the at least one nozzle to point away from the leg straps such that the housing is positioned between the pair of retractable lanyards and the harness and so that the single housing lays over the back of the worker, away from the legs of the worker when the harness is worn by the worker and so that the single housing pays out lanyard away from the legs of the worker from the back of the worker in the event of a fall, and whereby the pair of retractable lanyards are supported from the harness, so that the location of one of the lanyards can be ascertained by tracing the other lanyard.

2. A retractable lanyard mechanism according to claim 1 and further comprising a snap hook that is attached to at least one of the pair of retractable lanyards, and wherein said single housing is positioned between the snap hook and the harness.

3. A retractable lanyard mechanism for use by a worker having a back and legs, the retractable lanyard mechanism comprising:

a harness having a dorsal portion that is adapted for laying over the back of the worker when in use, the harness further comprising a set of leg straps;

a pair of retractable lanyards contained in a single housing, the housing has at least one payout nozzle that cooperates with at least one guide that divides the payout nozzle and separating the lanyards, the payout nozzle allowing the retractable lanyards to be drawn or retracted from the housing, the single housing being pivotally attached to the dorsal portion of said harness, each retractable lanyard comprising:

a drum that is rotatably supported within said single housing, the drum holding the lanyard in a spooled manner on the drum, the drum being connected to a locking mechanism that locks the drum in response to a level of rotational momentum achieved by the rotation of the drum, the locking mechanism comprising teeth on the drum and a pawl that pivots in response to sudden acceleration of the drum to engage at least one of the teeth on the drum to stop rotation of the drum, the rotation axis of the drum of each retractable lanyard being non-coaxial and generally parallel with the rotation axis of the drum of the other retractable lanyard and the lanyards extending from the housing such that the lanyards are paid out in a parallel fashion next to one another from a same side of each drum; and the housing including a link positioned between the drums and being mounted from the dorsal portion of the harness, the payout nozzle of the housing being between the link and the two lanyards, so that the single housing with the pair of retractable lanyards is supported from the dorsal portion of the harness, and so that the location of one of the lanyards can be ascertained by tracing the other lanyard when the housing is supported from the harness, and so that the lanyards support the worker from the dorsal portion of the harness so that the support of the worker is accomplished from the back of the worker and so that the link allows single housing to pivot away from the back of the worker to point away from the legs of the worker in the even of a fall.

4. A retractable lanyard mechanism for use by a worker, the worker having a back, the retractable lanyard mechanism comprising:

a harness having a dorsal portion that is adapted for laying over the back of the worker when in use, the harness further comprising a set of leg straps;

a support frame supporting a pair of retractable lanyards contained in a single housing, the housing has at least one payout nozzle that cooperates with at least one guide that divides the payout nozzle and separating the lanyards, the nozzle allowing the retractable lanyards to be drawn or retracted from the housing, the support frame including a link that retains the support frame pivotally attached to said dorsal portion of said harness, each retractable lanyard comprising:

a drum that is rotatably supported within said single housing, the drum holding the lanyard in a spooled manner on the drum, the drum being connected to a locking mechanism that locks the drum in response to a level of rotational momentum achieved by the rotation of the drum, the locking mechanism comprising teeth on the drum and a pawl that pivots in response to sudden acceleration of the drum to engage at least one of the teeth on the drum to stop rotation of the drum, the rotation axis of the drum of each retractable lanyard being non-coaxial and generally parallel with the rotation axis of the drum of the other retractable lanyard and each lanyard extending from the housing such that the lanyards are paid out in a parallel fashion next to one another from a same side of each drum from the frame support; and so that the single housing is supported from a location between the pair of retractable lanyards while the housing is supported directly from the dorsal portion of the harness and so that the link allows single housing to pivot up, away from the back of the worker with at least one lanyard pointing away from the legs of the worker in the event of a fall.

* * * * *